United States Patent [19]

Johnston

[11] 4,345,769

[45] Aug. 24, 1982

[54] DRILLING HEAD ASSEMBLY SEAL

[75] Inventor: Paul R. Johnston, Washington, Pa.

[73] Assignee: Washington Rotating Control Heads, Inc., Washington, Pa.

[21] Appl. No.: 244,026

[22] Filed: Mar. 16, 1981

[51] Int. Cl.[3] ..... F16J 15/56

[52] U.S. Cl. ..... 277/31; 175/195; 175/214;210;195

[58] Field of Search ..... 277/31, 30; 285/367

[56] References Cited

U.S. PATENT DOCUMENTS

| | | | |
|---|---|---|---|
| 3,400,938 | 9/1968 | Williams | 277/31 |
| 3,503,617 | 3/1970 | Williams | 277/9 |
| 4,143,880 | 3/1979 | Bunting et al. | 277/31 |
| 4,157,186 | 6/1979 | Murry et al. | 277/31 |
| 4,285,406 | 8/1981 | Garrett et al. | 277/31 |
| 4,293,047 | 10/1981 | Young | 277/31 |

*Primary Examiner*—Robert I. Smith

*Attorney, Agent, or Firm*—Carothers and Carothers

[57] ABSTRACT

In a drilling head assembly for rotary well drilling a tubular member has an external screw thread near its lower end, with the outer surface of the member below the thread tapering downwardly to its lower end to form a sealing surface. Screwed onto the thread is a metal ring that extends down past the sealing surface and is provided with an annular recess encircling and facing the sealing surface, from which it is spaced. A resilient sealing member encircles the ring and is secured to it, with the portion of the ring beside the sealing surface and below it embedded in the sealing member which also fills the annular recess in the ring. The sealing member converges downwardly below the ring to a neck portion, and the inner surface of the sealing member converges from above the annular recess downwardly to the neck portion so that the sealing member between the tapered sealing surface and the encircling portion of the ring is compressed by them to form a seal.

4 Claims, 5 Drawing Figures

DRILLING HEAD ASSEMBLY SEAL

In the rotary drilling of an oil or gas well a drilling head assembly is secured to the upper end of the well casing, and a drill string extends down through this assembly and the casing. The drilling head assembly includes an internal rotatable tubular member coaxial with the casing and having its lower end screwed into the upper end of a sealing unit often referred to as a stripper packer. The stripper packer includes a metal ring screwed onto the lower end of the tubular member and supporting a circular resilient sealing member extending down below it. The sealing member, which has a thick side wall, converges downwardly to a neck portion of reduced diameter that fits around the drill string to form a seal. As the drill string is rotated during drilling, it rotates the stripper packer and the tubular member with it. Such a stripper packer is shown by way of example in U.S. Pat. Nos. 3,400,938 and 3,503,617. A seal also should be provided between the tubular member and the stripper packer to prevent leakage of fluid between them during drilling. Heretofore, such a seal has been a separate sealing ring or gasket.

It is among the objects of this invention to provide in a drilling head assembly a stripper packer that is so formed that the act of screwing it onto the lower end of the rotary tubular member in the assembly forms a seal between them without the use of a separate sealing member.

The preferred embodiment of the invention is illustrated in the accompanying drawings, in which FIG. 1 is a side view, with half in vertical section, of a stripper packer attached to the lower end of a tubular member forming part of a drilling head assembly;

Figure 1:
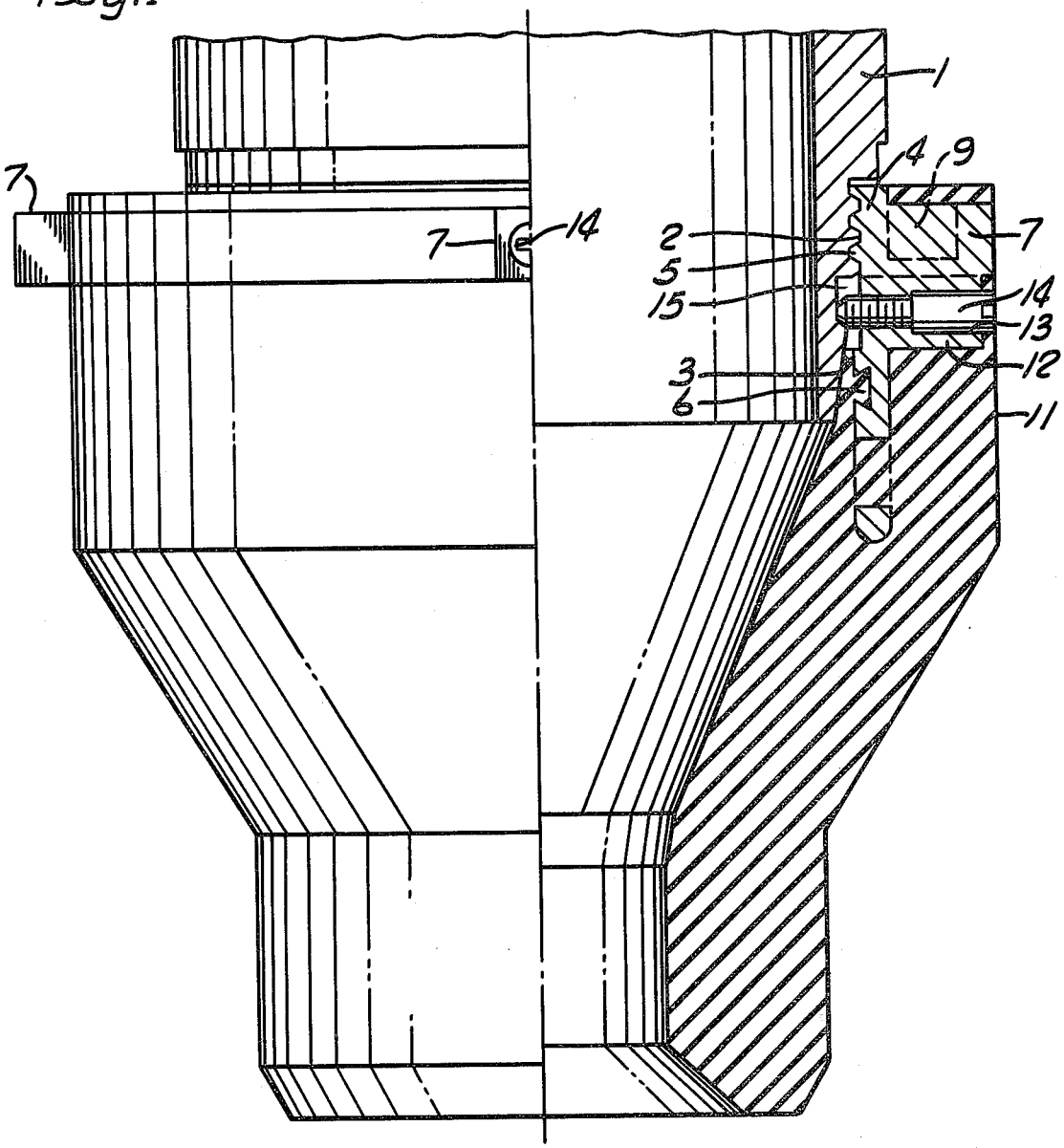
Figure 4:
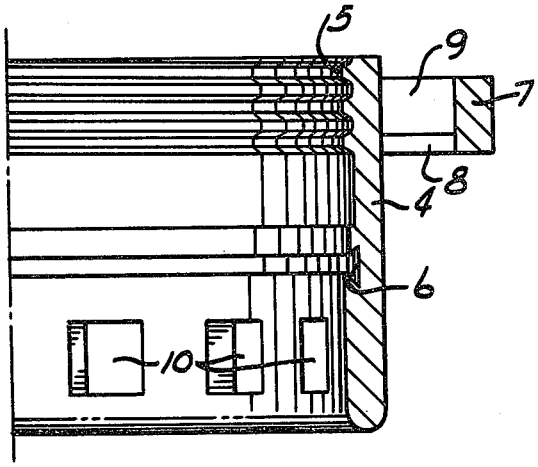
FIGS. 3, 4 and 5 are vertical sections taken on the lines III—III, IV—IV and V—V, respectively, of FIG. 2.
Figure 5:
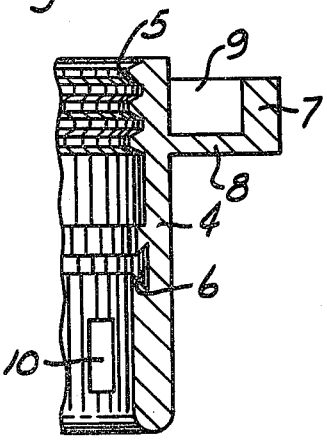
Figure 2:
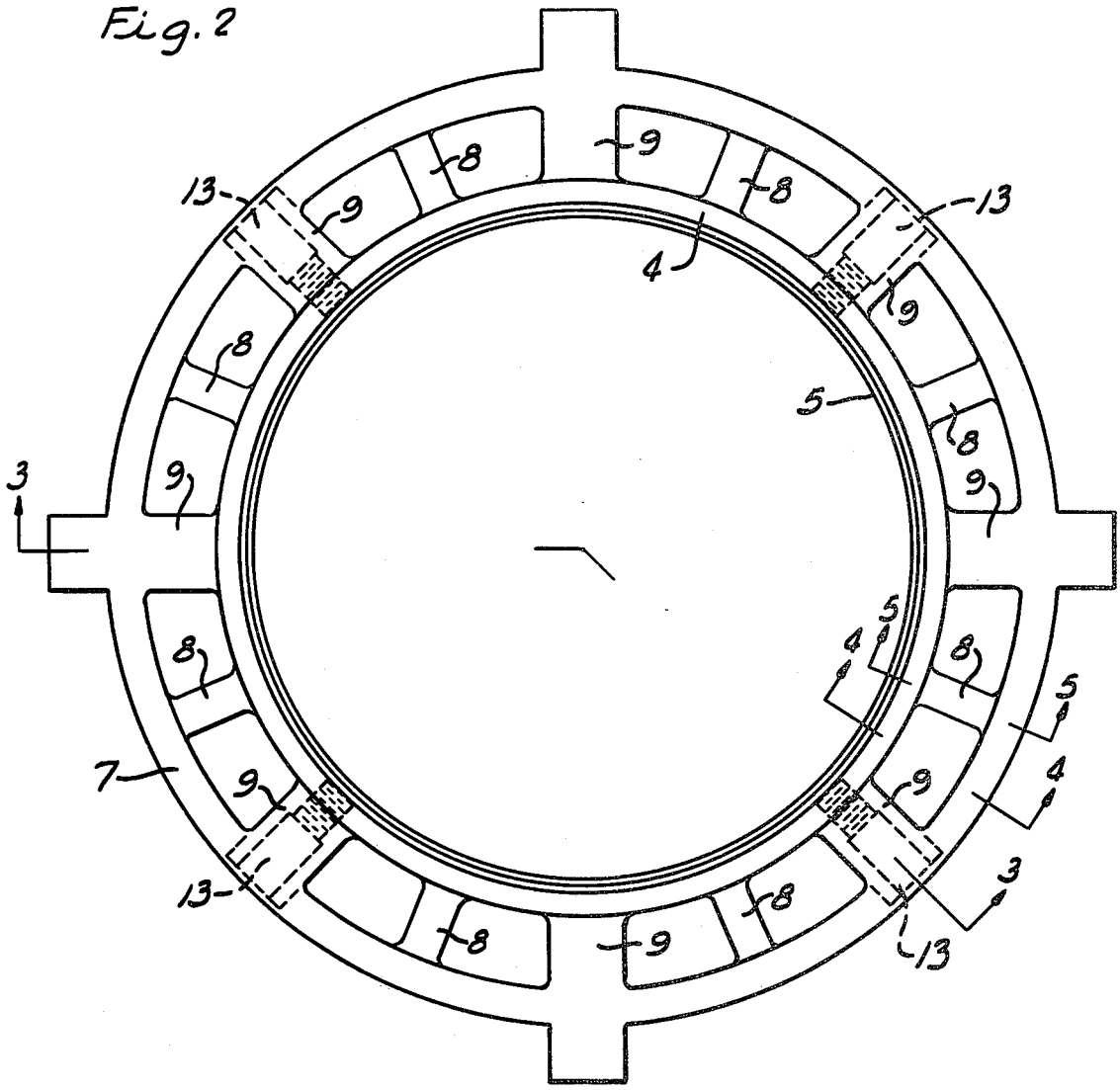
FIG. 2 is a plan view of the stripper packer itself.

Referring to FIG. 1 of the drawings, the lower end of a rotatable tubular member 1 that forms part of a drilling head assembly is provided with an external screw thread 2 a short distance above its lower end. The outer surface of this member below the screw thread tapers downwardly to the lower end of the tubular member to form a sealing surface 3. Screwed onto the tubular member is a stripper packer that includes a metal ring 4, the upper part of which is provided with screw threads 5 for engagement with the threads of the tubular member. The ring extends downwardly a short distance below the lower end of the tubular member. The portion of the ring beside sealing surface 3 is spaced from it and is provided with an annular recess 6 encircling and facing that surface for a purpose that will soon appear. As shown best in FIGS. 2 and 4, the upper part of the metal ring is encircled by a collar 7 that is spaced from the ring and supported by it by means of a plurality of circumferentially spaced spokes 8 and 9 integrally connected to both the ring and the collar. The portion of the ring below the tubular member 1 is provided with a plurality of circumferentially spaced openings 10 through it.

The stripper packer also includes a resilient circular sealing member 11 of rubber or other suitable material, the upper portion of which is secured to ring 4 as shown in FIG. 1. The thick wall of this sealing member converges downwardly beneath the tubular member to a neck portion of reduced diameter that will fit snugly around a drill string (not shown) extending down through the drilling head assembly. Preferably, sealing member 11 is secured to the metal ring by a molding operation so that the sealing material will extend through the spaces between the spokes and through openings 10 in the lower part of the ring. The portion of the ring beside the tapered sealing surface 3 and below it is embedded in the sealing member so that an integral portion of the sealing member is disposed between the sealing surface and the encircling ring and fills recess 6 in the ring.

When the stripper packer is screwed onto tubular member 1, sealing surface 3 of the latter will engage the encircling inner surface of sealing member 11. As the two members are screwed further together, the portion of the sealing member between the sealing surface and the encircling ring will be compressed between them to form a good seal. The projection of the sealing member into recess 6 prevents the tubular member from pushing the sealing material down out of place.

Figure 3:
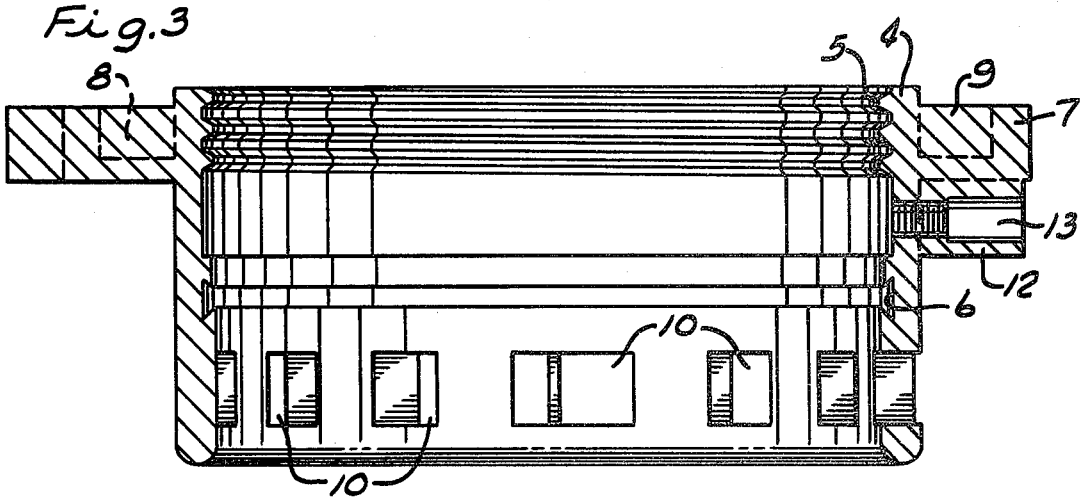

To lock the sealing member in place, at least one of the spokes 9 has a lower extension 12 that is provided with a passage 13 extending through it radially of the ring as shown in FIGS. 1 and 3. This passage is provided with a screw thread, in which a set screw 14 is screwed with the inner end of the screw pressed tightly against the tubular member. Preferably, the outer surface of the tubular member is provided with an annular groove 15 that receives the inner end of the screw. The tubular member and the stripper packer are screwed together far enough for the screw to project into the groove. The height of the groove is substantially greater than the diameter of the screw projecting into it, whereby to permit the tubular member to be screwed farther down into the stripper packer to form a better seal if that becomes necessary.

It will be seen that with this invention a good seal is formed between the stripper packer and the lower end of the tubular member by the simple act of screwing the two parts together. Moreover, the seal is formed without the use of a separate sealing ring or gasket, thereby simplifying and reducing the cost of the procedure.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a drilling head assembly for rotary well drilling, a vertically extending tubular member provided with an external screw thread adjacent to but spaced above its lower end, the outer surface of said member below said screw thread tapering downwardly to said lower end to form a sealing surface, a metal ring encircling said screw thread and sealing surface and provided with an internal screw thread engaging said first-mentioned thread for connecting the ring to said tubular member, the portion of said ring beside said sealing surface being spaced therefrom and extending downwardly below it and provided with an annular recess encircling and facing said surface, and a resilient sealing member encircling said ring and secured thereto with the portion of the ring beside said sealing surface and below it embedded in the sealing member, the sealing member filling said annular recess and converging downwardly below said ring to a neck portion of reduced diameter for fitting around a drill string, and the inner surface of the sealing member converging from above said annular recess downwardly to said neck portion, the sealing member being compressed between said tapered sealing surface and the encircling portion of said ring to form a seal between said tubular member and ring.

2. In a drilling head assembly according to claim 1, a flange encircling said ring and spaced therefrom, a plurality of circumferentially spaced spokes integrally connecting said ring and flange, at least one of said spokes having a lower extension provided with a passage therethrough extending radially of the ring, said passage being provided with a screw thread, and a set screw screwed into said passage and bearing against said tubular member.

3. In a drilling head assembly according to claim 2, the outer surface of said tubular member being provided with an annular groove receiving the inner end of said screw.

4. In a drilling head assembly according to claim 3, the height of said groove being substantially greater than the diameter of said screw therein to permit limited vertical adjustment of said tubular member in the ring while the set screw is projecting into the groove.

* * * * *